US008430461B1

(12) United States Patent
Cole

(10) Patent No.: US 8,430,461 B1
(45) Date of Patent: Apr. 30, 2013

(54) FURNITURE WITH FIREARM ACCESS FEATURES

(75) Inventor: Joseph W. Cole, Las Vegas, NV (US)

(73) Assignee: JPL Investments, LLC, Las Vegas, NV (US)

( * ) Notice: Subject to any disclaimer, the term of this patent is extended or adjusted under 35 U.S.C. 154(b) by 0 days.

(21) Appl. No.: 13/299,187

(22) Filed: Nov. 17, 2011

(51) Int. Cl.
*A47B 88/00* (2006.01)
*A47B 17/06* (2006.01)

(52) U.S. Cl.
USPC ..... 312/204; 312/330.1; 312/302

(58) Field of Classification Search ..... 312/204, 312/330.1, 319.1, 298, 301, 302, 303; 206/317; 70/58, 85; 224/243, 912
See application file for complete search history.

(56) References Cited

U.S. PATENT DOCUMENTS

| | | | | | |
|---|---|---|---|---|---|
| 128,439 | A | * | 6/1872 | Unna | 312/204 |
| 554,452 | A | * | 2/1896 | Munich | 312/221 |
| 623,537 | A | * | 4/1899 | Grange | 312/273 |
| 731,330 | A | * | 6/1903 | Woodruff | 312/309 |
| 865,953 | A | | 6/1907 | Hartmann | |
| 1,112,733 | A | * | 10/1914 | Umphrey et al. | 312/266 |
| 1,358,004 | A | * | 11/1920 | Lietz | 312/267 |
| 1,371,890 | A | * | 3/1921 | Gustavel | 312/303 |
| 1,381,301 | A | | 6/1921 | Hargrave | |
| 1,437,665 | A | | 12/1922 | Lewis | |
| 1,450,974 | A | * | 4/1923 | Heotes | 312/204 |
| 1,506,348 | A | | 8/1924 | Kamin | |
| 1,577,366 | A | * | 3/1926 | Ruocco | 312/225 |
| 1,578,552 | A | | 4/1926 | Ludlow | |
| 1,811,978 | A | | 6/1931 | Shine | |
| 1,895,061 | A | * | 1/1933 | Worssam | 132/287 |
| 2,424,144 | A | * | 7/1947 | Bruen | 312/189 |
| 2,450,447 | A | | 10/1948 | Samuel | |
| 2,621,098 | A | * | 12/1952 | Ford et al. | 312/204 |
| 3,796,358 | A | | 3/1974 | Grubb | |
| 3,836,222 | A | * | 9/1974 | Kuntze | 312/9.57 |
| 4,082,386 | A | * | 4/1978 | Beasley, Jr. | 312/204 |
| 4,187,797 | A | | 2/1980 | Hoinski | |
| 4,570,890 | A | | 2/1986 | Lohn | |
| 4,768,021 | A | | 8/1988 | Ferraro | |
| RE32,753 | E | * | 9/1988 | Ackeret | 206/387.12 |
| 4,800,822 | A | | 1/1989 | Adkins | |
| 4,838,626 | A | * | 6/1989 | Parr | 312/333 |
| 5,048,682 | A | | 9/1991 | Taylor | |
| 5,168,994 | A | | 12/1992 | Beletsky et al. | |
| 5,188,328 | A | | 2/1993 | Thompson | |
| 5,344,010 | A | | 9/1994 | Dyer et al. | |
| 5,375,440 | A | | 12/1994 | Patterson | |
| 5,437,366 | A | | 8/1995 | West et al. | |
| 5,916,087 | A | | 6/1999 | Owens | |
| 5,944,396 | A | * | 8/1999 | Stephan | 312/204 |

(Continued)

*Primary Examiner* — James O Hansen
(74) *Attorney, Agent, or Firm* — Weide & Miller, Ltd.

(57) ABSTRACT

An article of furniture, such as a night stand, is configured with firearm access features. A drawer of the article of furniture may include a mount for holding a firearm in the drawer. The mount may be configured to move a firearm from a horizontal storage position to a vertical position when the drawer is opened. The drawer may include a firearm locator feature comprising an arm-locating cut-out in a side of the drawer. The drawer may also include an access feature for selectively maintaining the drawer in a closed position and ejecting the drawer to an extended position, such as upon release of a catch which permits a spring to bias the drawer outwardly. The access features secure the firearm and at the same time permit expedited access to the firearm, including in the dark.

20 Claims, 3 Drawing Sheets

U.S. PATENT DOCUMENTS 6,059,388 A * 5/2000 Wheatley, Jr. ..... 312/246
6,082,601 A 7/2000 Standish
6,405,861 B1 6/2002 Siler et al.
6,802,578 B1 * 10/2004 Lang et al. ..... 312/235.1

* cited by examiner

FURNITURE WITH FIREARM ACCESS FEATURES

FIELD OF THE INVENTION

The present invention relates to devices for storing and accessing firearms.

BACKGROUND OF THE INVENTION

Firearms are commonly used for protecting persons and property. Many homeowners own firearms for the protection of themselves and their homes.

Because of the safety issues associated with firearms, homeowners often store their firearms in locked safes or cabinets. However, this makes the firearms difficult to access in the event of an emergency.

For example, a homeowner may keep their firearms in a combination wall-mounted safe. In the event of a home robbery, however, the homeowner could only access their weapon by successfully entering the combination to the safe, opening the door to the safe, and then finding and removing the firearm from the safe. In many cases, the safe is likely to also be located remote from the homeowner, adding to the time necessary for the homeowner to access the weapon. The length of time needed for the homeowner to access their firearm in this type of arrangement actually prevent the homeowner from reaching their weapon in time to make it useful.

An improved arrangement for storing and accessing firearms, particularly in a home environment, is desired.

SUMMARY OF THE INVENTION

The invention comprises various firearm access features. Embodiments of the invention comprise a firearm orientation feature, a firearm locator feature and a firearm access control feature.

The firearm access features of the invention have particular utility to an article of furniture. The article of furniture may comprise a night stand, table, dresser or the like. The article of furniture preferably includes at least one drawer in which a firearm may be stored. The drawer is preferably movable between a first position in which it is located in the article of furniture and a second position in which the drawer is extended outwardly of the article of furniture. In its first position, an interior of the drawer is generally inaccessible an in its second position the interior of the drawer is generally accessible.

When applied to a drawer of an article of furniture, the firearm access control feature preferably comprises a means for controlling movement of the drawer between its first and second positions. In one embodiment, a latch maintains the drawer in a closed position. A biasing mechanism, such as a spring, is configured to move the drawer from its first to its second position. When latched, the latch maintains the drawer in the closed position against the biasing force. When the latch is released, the biasing mechanism preferably ejects the drawer outwardly to its second position, such as to provide access to a firearm therein.

In one embodiment, the latch includes a catch. In one position the catch latches the drawer. In another position the catch is released. The catch may selectively be actuated by a user, such as by an actuating wire. The wire may have one end connected to the catch and an opposing end located remote from the catch, such as at a position at the exterior of the article of furniture where it is accessible by a user.

When applied to such a drawer, the firearm locator feature is preferably configured to aid a user in locating a firearm in the drawer. In a preferred embodiment, the firearm locator feature comprises an arm-accepting cut-out extending downwardly from a top edge of one or both sides of the drawer. The cut-out may be generally "U" shaped so as to accept a user's arm/wrist.

The firearm orientation feature may comprise a firearm holder. The holder is preferably located in the drawer. When the drawer includes a firearm locator feature, the holder is configured to position the firearm in alignment with the locator feature.

In one embodiment the holder comprises a firearm mount. In a preferred embodiment the mount is movably mounted to a base so that the mount can be moved from a first position to a second position. The mount may define a firearm supporting surface. In its first position, the supporting surface of the mount may be generally horizontal. A firearm may thus be stored in a horizontal, reduced profile on the support surface. In its second position, the supporting surface of the mount may be generally vertical. In this position, a firearm located on the mount is oriented generally vertically for grasping and use by a user.

The holder may include means for moving the mount from its first to its second position when the drawer is moved from its closed to its open position. In this manner, a firearm is stored in a flat, reduced profile position when the drawer is closed. When the drawer is opened, or ejected using the access control feature of the invention, the firearm is moved to an upright position in alignment with the firearm locator feature.

In accordance with the invention, firearm access features are provided which render a firearm selectively more accessible. The features may be used separately or together. The features have the particular advantage of securing a firearm for use and yet rendering a firearm quickly accessible in a home environment, such as when a user sleeping in a dark bedroom at night.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Various aspect of the invention comprise firearm storage and access devices and methods. In a preferred embodiment, an article of furniture is configured with firearm storage and access features. The furnishing may comprise a nightstand having a drawer with an automatic open/release feature and having features for rendering a firearm quickly accessible by a user.

Figure 1:
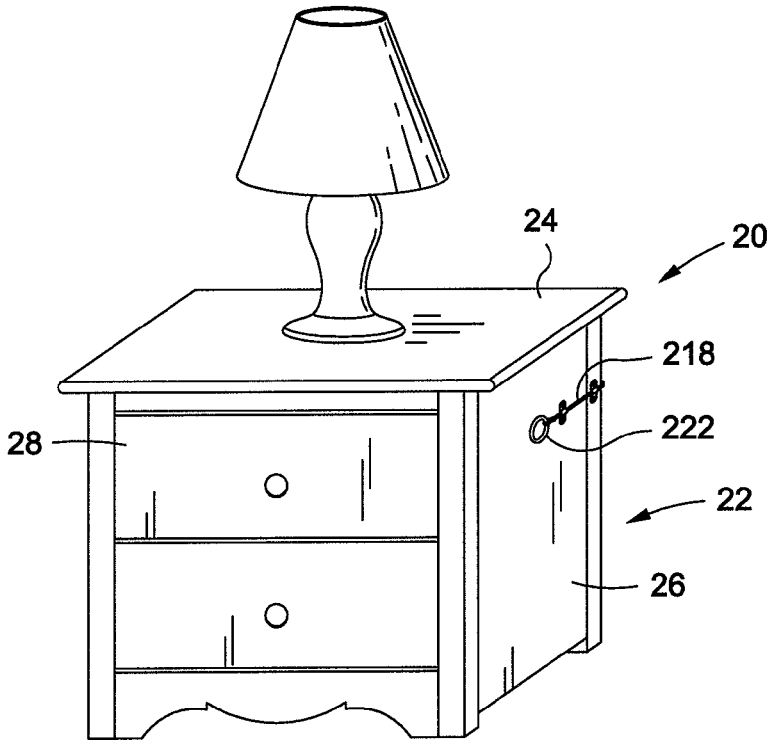
FIG. 1 is a perspective view of a night stand comprising an environment for firearm access features of the invention.

FIG. 1 illustrates one environment of use of the invention. As illustrated, an article of furniture is provided with firearm access features. In one embodiment, the article of furniture may comprise a nightstand 20. The nightstand 20 may comprise a housing 22 having a top 24 and one or more sides 26. The housing 22 may have a front and rear and generally define an interior space.

In a preferred embodiment, the nightstand 20 has at least one drawer 28. The drawer 28 may be mounted for movement relative to the housing 22, whereby the drawer 28 may be selectively moved into and out of the housing 22. As is well known, when the drawer 28 is in a first, closed position, an interior portion of the drawer 28 is generally in accessible as it is located in the interior of the nightstand 20. On the other hand, as detailed below, when the drawer 28 is in a second, open position, the interior portion thereof is accessible.

One aspect of the invention comprises a firearm locator feature. In accordance with one aspect of the invention an article of furniture, such as the above-described nightstand 20, is provided with such a feature. In a preferred embodiment, one firearm locator feature comprises an arm locating cut-out 30. The cut-out 30 is preferably associated with the drawer 28 of the nightstand 20.

Figure 3:
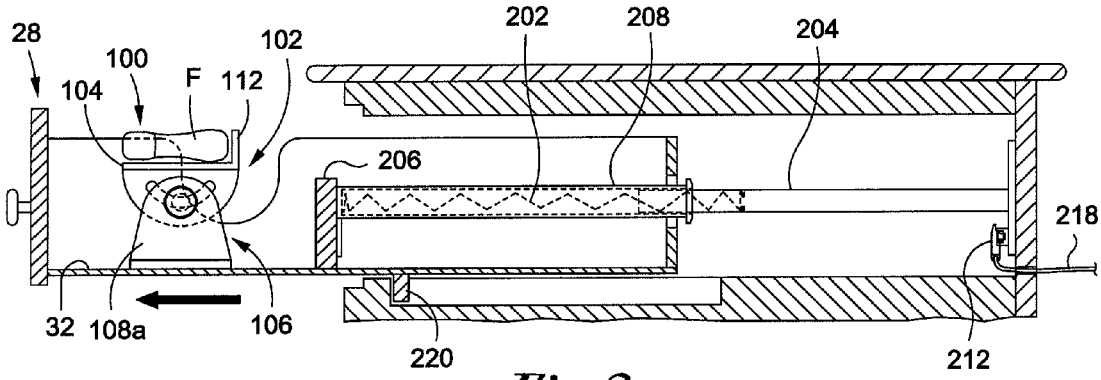
FIG. 3 is a cross-sectional side view of the night stand illustrated in FIG. 2, illustrating the drawer in an extended position and illustrating a firearm holder and firearm locator feature of the invention.

In one embodiment, the drawer 28 has a standard configuration of a base or bottom 32 having one or more walls extending upwardly there from, such as a pair of opposing sidewalls 34,36, a front 38 and a rear 40 (see FIG. 3). In such a configuration, the sidewalls 34,36 extend between the front 38 and rear 40 of the drawer 28 and are spaced from one another. A storage space is defined within the wall(s) of the drawer above its bottom 32.

As illustrated, each sidewall 34,36 may have a bottom portion or edge near the bottom 32 of the drawer 28 and an opposing top edge 42. The top edge 42 may generally be planar or straight.

In one embodiment, as indicated, the drawer 28 includes an arm-location feature which preferably comprises a locating cut-out 30. The cut-out 30 preferably comprises a recess or depression in at least one of the sidewalls 34,36. The cut-out 30 comprises an area where the top edge 42 of the sidewall 34,36 is reduced or lowered compared to the remainder thereof. The cut-out 30 is preferably shaped and sized to receive a portion of a person's arm therein. As such, the cut-out 30 may be generally semi-circular in shape, though it may have other configurations. In one embodiment, the cut-out 30 is about 3-5 inches in width and about 2-4 inches in maximum depth (from the remainder of the top edge 40 of the sidewall 34,36).

A cut-out 30 may be provided in one or both of the sidewalls 34,36. The location of either or both cut-outs 30 may vary. In a preferred embodiment, the cut-outs 30 are located near the front 38 of the drawer 28 so that they are useful when the drawer 28 is only partially removed from the housing 22 of the nightstand 20 or other article of furniture.

In use, a user may locate a firearm 28 in the drawer 28, such as by laying the firearm on the bottom 32 of the drawer 20. In a preferred embodiment, the user locates the firearm in alignment with the cut-out(s) 30.

When the drawer 28 is closed, the firearm is generally inaccessible. A user may open the drawer 28 to access the firearm. When the drawer 28 is opened, the user may reach their arm towards the drawer so that their hand is located in the interior portion of the drawer 28. Preferably, the user locates their arm in the cut-out 30 by reaching towards the drawer 28 when the drawer is in an open position. Notably, the shape of the cut-out 30 causes the cut-out to be self-locating. In particular, if the user moves their arm directly into alignment with the cut-out 30, the user can confirm that their arm is in the cut-out by moving their arm from side-to-side slightly. If the user's arm is in the cut-out 30 it will hit the sides of the cut-out. On the other hand, if the user's arm is not in the cut-out 30, it will slide along the top edge 42 of the side of the drawer. In that event, movement of the user's arm will eventually result in the user's arm reaching the cut-out 30 and falling into the cut-out.

Importantly, the cut-out 30 aids the user in location the firearm. Once the user's arm is located in the cut-out, the user can grasp the firearm F (see FIG. 2) which is positioned in the drawer. First, the reduced depth of the side of the drawer 28 at the location of the cut-out 30 causes the user's hand to be located closer to the level of the firearm (i.e. closer to the bottom 32 of the drawer 28 than if the user had to reach over the top edge 42 of the sidewall). Second, the firearm is preferably located in alignment with the cut-out 30. Thus, when the user's hand is located in the cut-out 30, the user's hand is positioned at or adjacent the firearm F.

Another aspect of the invention comprises a firearm orientation feature. The firearm orientation feature is preferably associated with an article of furniture, such as the above-described nightstand 20. In one embodiment, the firearm orientation feature comprises a firearm holder 100.

Figure 4:
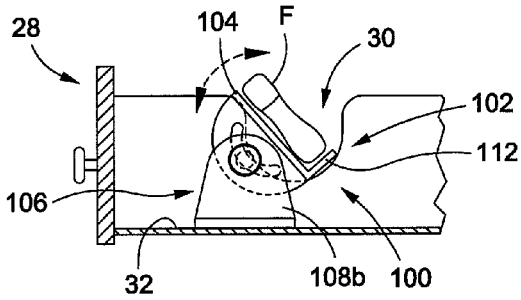
FIG. 4 illustrates a movement feature of the firearm holder of the invention.
Figure 5:
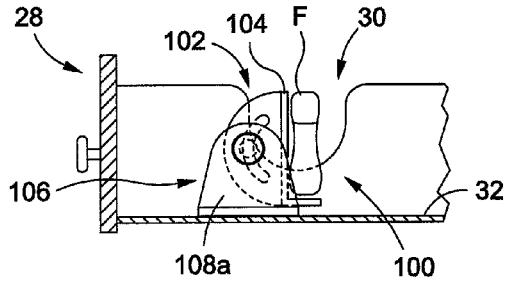
FIG. 5 illustrates the firearm holder of the invention in a second position varied from the position illustrated in FIG. 3.

In one embodiment, the firearm holder 100 comprises a mount 102. Preferably, the mount 102 is configured to support a firearm F, as best illustrated in FIGS. 3-5. As illustrated, the mount 102 preferably defines a supporting surface 104, such as a generally planar platform. The supporting surface 104 preferably supports a firearm F so that it is easily grasped by a user. Thus, while the supporting surface 104 could define one or more recesses or the like into which a firearm F could be located, such a configuration is less desirable to the extent that such makes it more difficult for a user to grasp the firearm F for use.

In one embodiment, the holder 100 may include means for maintaining a firearm F in position on the mount 102. For example, the mount 102 might comprise one or more upwardly extending pins, tabs, side walls, rims or the like. Such members may serve to maintain the firearm F on the mount 102, such as when the mount 102 is moved (such as when a drawer is moved in an out as detailed below). Preferably, however, such members do not interfere with the user's ability to grasp the firearm F for use (including lifting the firearm F off of the mount 102 for use.

In one embodiment, the supporting surface 104 is located in an elevated position. As illustrated, the holder 100 may further comprise a stand 106. The mount 102 may be connected to the stand 106. The stand 106 may have a bottom surface for connection or support by a supporting surface, such as the bottom 32 of the drawer 28. The mount 102 preferably extends upwardly from the stand 106, such as above a top of the stand 106.

The stand 106 may have various configurations. In one embodiment, as illustrated, the stand 106 may comprise a pair of upwardly extending risers 108*a,b* (see FIG. 2). The risers 108*a,b* may be connected, such as by a bottom support 110.

In a preferred embodiment of the invention, the mount 102 is configured for movement so that the orientation of a firearm F thereon can be changed. In a preferred embodiment the mount 102 is movable between a first position in which a firearm F is stored in a generally planar position, as best illustrated in FIG. 3, and an access position in which the firearm F is upright or generally upright, as best illustrated in FIGS. 4 and 5.

As illustrated, the mount 102 is movably mounted to the stand 106. In one embodiment, the mount 102 is pivotally or rotatably mounted to the stand 106. For example, opposing ends of the mount 102 may be pivotally mounted to the two risers 108*a,b* of the stand 106. As illustrated in FIG. 3, in a first or storage position, the mount 102 is oriented so that the supporting surface 104 is generally horizontal. In this position, a firearm F may be positioned in a corresponding horizontal position on the mount 102. As illustrated in FIGS. 4 and 5, however, the mount 102 may be rotated to a second or access position. In this position, the mount 102 is oriented so that the supporting surface 103 is generally vertical. In this position, a firearm F thereon is positioned in a corresponding vertical position on the mount 102.

In a preferred embodiment, the firearm orientation feature is used in conjunction with the firearm locator feature. In such a configuration, the holder 100 is preferably configured and/or oriented so that when the mount 102 is moved to its second or access position, the firearm F is aligned with the cutout 30 or other locator feature. For example, as illustrated in FIGS. 3-5, when the mount 102 merely rotates, a firearm F may be located forwardly (i.e. out of direct alignment with) the cut-out 30 when the mount 102 is its first position. However, when the mount 102 is rotated, this allows the firearm F to move into direct alignment with the cut-out 30.

In other embodiments, however, the mount 102 might have other ranges of movement, such as sliding or tilting in addition to rotating. These other configurations may permit the mount 102 to support the firearm F in alignment with the cut-out 30 when the mount 102 is in both its first and second positions.

As indicated above, means may be provided for maintaining the firearm F on the mount 102. As illustrated, such a means may be used to support the firearm F when the mount 102 is moved to its second, generally vertical position. As indicated, various means might be used to support the firearm F, such as pins or the like. In the illustrated embodiment, the mount 102 comprises a stop 112 which extends outwardly of the supporting surface 104. The stop 112 may comprise, for example, a ledge or wall which extends outwardly generally perpendicular to the supporting surface 104. The stop 112 may support, for example, at least the butt of the firearm F when the firearm F is in its vertical position as illustrated in FIG. 5.

In one embodiment, means may be provided for moving the mount 102 from its first to its second position. In a preferred embodiment where the holder 100 is associated with a drawer 28, as illustrated in FIG. 3, the mount 102 is configured to move from its first to its second position when the drawer is opened. In this configuration, when the drawer 28 is in its closed position, the mount 102 is preferably in its first position. In this position, the firearm F is generally horizontal, thus reducing its profile so that it fits within the drawer and does not interfere with movement of the drawer. However, when the drawer 28 is opened, the firearm F moves to the position illustrated in FIG. 5 wherein it is oriented to be grasped by a user. Similarly, when the drawer 28 is moved from its open position back to its closed position, the mount 102 may automatically be moved back to its first position.

Various means may be utilized to move the mount 102 from its first to its second position. In one embodiment, as detailed below, means may be provided for ejecting the drawer 28. The means for moving the mount 102 may be associated with the means for ejecting, whereby when the drawer is ejected, the mount 102 is moved as well. However, the two means may also be independent. The means for moving the mount 102 may be mechanical or electro-mechanical. For example, a controller may control an electric motor which rotates the mount 102. An electric eye or similar sensor may be used to detect the position of the drawer (such as by detecting light, the position of the drawer or movement of the drawer). Such a sensor may provide an input to the controller. Based upon a signal from the sensor, the controller may activate the motor to move the mount 102.

In another embodiment, a means may be provided for biasing the mount 102, such as one or more springs. The one or more springs may bias the mount 102 to the second position. The mount 102 may be latched into its first position. When the drawer 28 is opened, a release may be actuated which releases the latch. This may allow the one or more springs to cause the mount 102 to rotate.

Of course, a variety of devices may be used to move the mount 102 other than those specifically described herein.

Another aspect of the invention comprises a firearm access control feature. The firearm access control feature is preferably associated with an article of furniture, such as the above-described nightstand 20. In one embodiment, the firearm access control feature comprises a drawer ejector.

Figure 6:
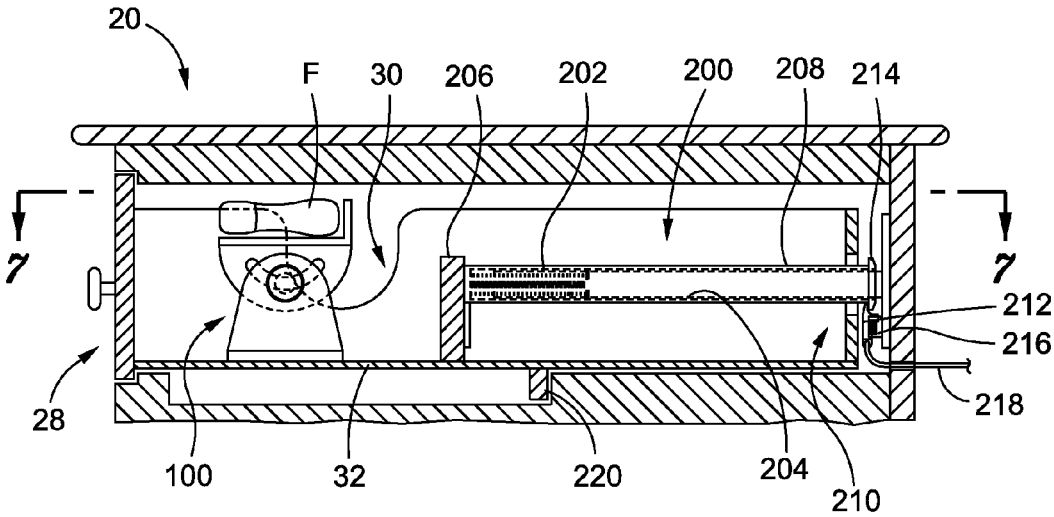
FIG. 6 is a cross-sectional side view of the night stand illustrated in FIG. 2, illustrating a firearm access control feature in a first position.
Figure 7:
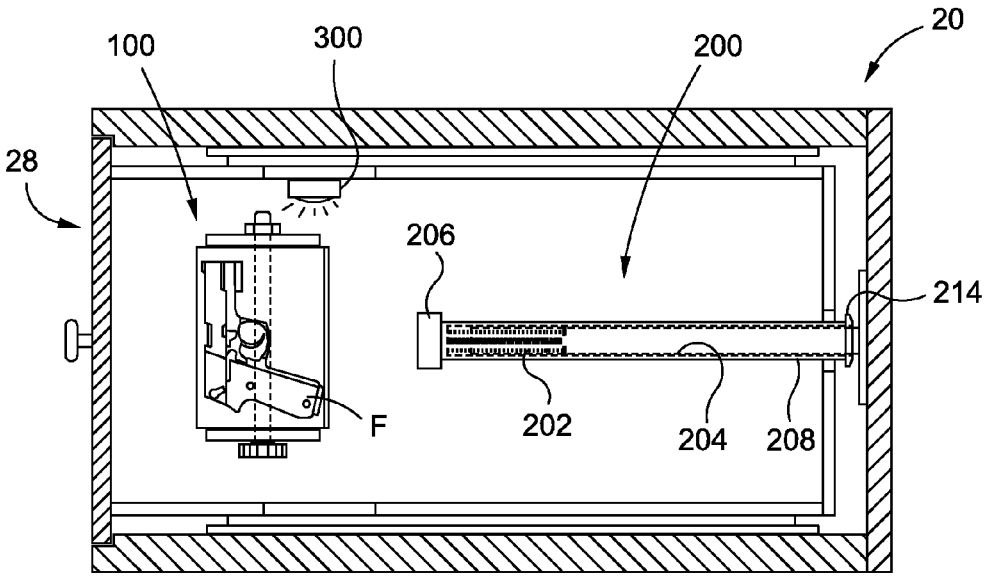
FIG. 7 is a view of the drawer of the night stand illustrated in FIG. 6 taken along line 7-7 therein.

One embodiment of a drawer ejector 200 will be described with reference to FIGS. 6 and 7. As illustrated therein, the drawer ejector 200 preferably comprises a means for moving a drawer 28 from a closed to an open position without the user having to pull the drawer to move it to its open position.

The means for moving may comprise various mechanical or electro-mechanical devices. For example, such means might comprise a motor turns a gear, pulley or the like. The gear, pulley or other driven output may cause the drawer 28 to move.

In a preferred embodiment, the means may comprise a biasing element, such as one or more springs 202. The spring(s) 202 may be configured to bias the drawer 28 to its open position. In this configuration, when the drawer 28 is moved to its closed position the spring(s) 202 may be compressed or the like. When released, the spring(s) 202 may then move the drawer to its open position.

As illustrated, a spring 202 may be mounted to a slide 204. For example, a first end of the spring 202 might be mounted to the slide 204. The slide 204 might comprise, for example, an elongate rod.

A second end of the spring 202 is preferably mounted to or engages a stop 206. The slide 204 and spring 202 may be mounted within a latch body 208.

The latch body 208 may, for example, comprise a hollow tube. The latch body 208 preferably has a first end and a second end. The first end may extend through a rear of the drawer 28 and the second end may be connected to the stop 206.

In one embodiment, the ejector 200 further comprises a latch 210. The latch 210 is preferably configured to selectively retain the drawer 28 in its closed position against the biasing force of the spring(s) 202. The latch 210 may comprise a catch 212 which is movable between a first position and a second position. The catch 212 may comprise a body having a first end or portion and a second or portion and be configured with a pivot point between the ends. The first end of the catch 212 is preferably configured to engage a portion of the latch body 208, such as a head 214 at the first end of the latch body 208. The second end of the catch 212 may define an actuator connection, as described in more detail below.

As indicated, the catch 212 may be pivotally mounted, such as to a base 216. The base 216 may be configured to be mounted to a supporting surface, such as an interior surface of the night stand 20, as illustrated in FIGS. 3, 6 and 7. In one embodiment, the latch 210 may include means for biasing the catch 212 to its first or engaging position. This means might comprise one or more springs or the like. The means for biasing preferably biases the catch 212 into a position in which it engages the latch body 208.

The latch 210 preferably further comprises an actuator 218. The actuator 218 is configured to permit a user to selectively disengage the catch 212 from the latch body 208, thus releasing the ejector, resulting in the drawer 28 being moved to its extended position. The actuator 218 might comprise various means for receiving input from a user and then releasing or moving the catch 212, including various mechanical or electro-mechanical means. These means might comprise, for example, an actuating wire. The wire might have a first end connected to the second end of the catch 212, and having a second end located remote from the catch 212, such as at the exterior of the night stand 20. The second end of the wire might define a loop, ring 222 or other member (see FIG. 1) which is easily grasped or engaged by one or more fingers or the hand of a user, thus permitting the user to easily pull the actuating wire to release the catch 212. In one embodiment, the actuating wire might be located in a protective sleeve (not shown). The protective sleeve might be securely mounted to the night stand 20, a wall or other mount, thus routing the actuating wire along a defined path to a preferred location, but yet permitting the actuating wire to move within the sleeve.

In other embodiments, the means for actuating might comprise a motor. A button might be provided remote from the catch 212. The button might transmit a signal over wires or wirelessly to the motor (or a controller thereof), which signal causes the motor to move the catch 212, thus releasing it. In one embodiment, the button might comprise a keypad or other security device which requires that the user input a code or the like in order to cause the motor to actuate the catch 212. In this manner, only an authorized user may actuate the catch 212 and release the drawer 28 and thus gain access to the firearm F inside the drawer.

Of course, other types of releases may be provided for selectively controlling the ejection of the drawer. As indicated, for example, the movement of the drawer could be controlled entirely by a motor. For example, the motor might drive a screw in first or second directions. When driven in a first direction, the screw might move the drawer 28 outwardly, and when driven in the opposite direction, the screw might move the drawer 28 inwardly.

In a preferred embodiment, however, the means for moving the drawer 28 is configured to move the drawer 28 to its open position very quickly. Thus, in the event of an emergency a user can cause the drawer 28 to be moved to its open position very quickly so as to gain access to the firearm F therein very quickly. In addition, the means for moving is also preferably configured to secure the drawer 28 in its closed position. In this manner, the drawer 28 is secured against unauthorized access to secure the firearm F therein.

In one embodiment, the ejector 200 may include a drawer stop 220. The drawer stop 220 may be configured to limit the travel of the drawer 28, such as to prevent it from moving outwardly too far and/or to cause the drawer 28 to stop in a particular open position. The drawer stop 220 may comprise, for example, a body which extends outwardly from the drawer 28, such as the bottom 32 thereof, as illustrated in FIG. 6. The drawer stop 220 may be sized and positioned to engage another member to stop it, such as by contacting another portion of the night stand 20.

Additional aspects of the invention will be appreciated from a description of the operation of the invention. Referring to FIG. 1, a firearm may be stored in a drawer 28 of an article of furniture, such as a nightstand 20. When the drawer 28 is in its closed position, the firearm is contained inside the night stand 20 and is generally inaccessible.

A user may open the drawer 28 to access the firearm. When the drawer 28 is configured with an ejector 200, the user may actuate the ejector 200. For example, the user may grasp the ring 218 and pull the actuating wire 222. Referring to FIGS. 3, 6 and 7, movement of the actuating wire 222 preferably moves the catch 212 to a position in which it does not engage the latch body 208. At that time, the force of the spring 202 causes the drawer 28 to move outwardly of the night stand 20, as best illustrated in FIG. 3. As indicated, movement of the drawer 28 may be limited by the drawer stop 220. At this time, the drawer 28 is in a position where the contents thereof, such as a firearm F therein, are accessible.

As indicated, in a preferred embodiment, the drawer 28 may include a firearm F orientation feature, such as the firearm holder 100. As described above, the holder 100 may be configured to locate the firearm F in a desired position for removal from the drawer 28. In the preferred embodiment, as best illustrated in FIG. 6, when the drawer 28 is in its closed position the holder 100 is configured to maintain a firearm F in a generally planar or horizontal position (thus reducing the profile thereof). However, as illustrated in FIGS. 4 and 5, when the drawer 28 is moved to its open position, the holder 100 is preferably configured to move the firearm F to a vertical position for grasping by a user. As indicated above, this may be affected by moving a mount 102 of the holder 100, such as rotating the mount 102. In this manner, the firearm F is moved to a position in which it is most easily grasped by a user and a position where the firearm F is ready for use.

Figure 2:
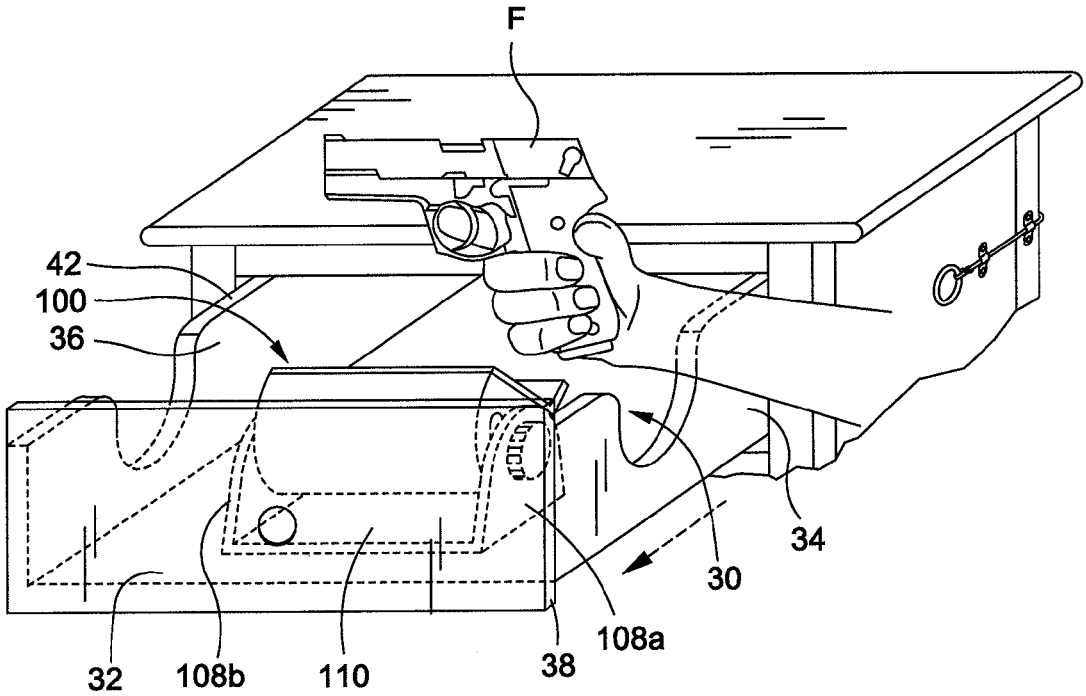
FIG. 2 illustrates a drawer of the night stand of FIG. 1 in an open position, permitting a user to grasp a firearm within the drawer.

In a preferred embodiment, the user's ability to locate and remove the firearm F from the drawer 28 is preferably enhanced by the locator feature. As indicated, in a preferred embodiment, the drawer 28 includes one or more locating cut-outs 30, as best illustrated in FIG. 2. As indicated above, when the drawer 28 is opened, the user may move their arm until they sense that it is in the cut-out 30. At that time the user knows that their hand is aligned with the firearm F in the drawer 28. The user then need only open their hand over the firearm F and then grasp the firearm F for removal.

Additional aspect of the invention will now be described. In one embodiment, means may be provided for illuminating a firearm F for access. Such a mean may be used to illuminate a firearm F for removal from a storage compartment, such as a drawer 28 of an article of furniture such as described above. For example, referring to FIG. 7, in one embodiment a light 300 may be located inside of the drawer 28. The light 300 may be configured to illuminate a firearm F stored in the drawer 28, such as on the holder 100.

The light 300 may be of various types. For example, the light 300 could comprise an LED, incandescent, fluorescent or other type of light. The light 300 might include one or more than one illumination element, such as one or more than one bulb. The light 300 might be powered in various manners, such as batteries, or via other DC or AC sources.

As indicated above, means may be provided for limiting the ability to actuate the actuator of the drawer 28, thus limiting the one or more users who may open the drawer. In one embodiment, children might be prevented from opening the drawer 28 by sizing the ring 222 so that it cannot easily be grasped by a child or by causing the actuating force necessary to release the catch 212 to be higher than a child could normally apply to the actuating wire 218. In other embodiments, however, the latch might include a control which requires input of a unique user code, a fingerprint or other identifier. In yet another embodiment, a key or other unique element might be required to unlock or actuate the actuator.

In one embodiment, the light 300 may be configured to illuminate when the drawer 28 is moved to its open position and be configured to shut off when the drawer is moved to its closed position. For example, a switch, controller or the like may be utilized to turn on and off the light as a result of such movement of the light. When the light 300 is used with a drawer 28 having the ejector or mount moving features of the invention, the light may be configured to be activated when such other features are activated. For example, when the drawer ejector is activated, the light 300 might be configured to also be activated.

It will be appreciated that the various features of the invention may be implemented in a newly constructed article of furniture or by retrofit. For example, a drawer of an existing nightstand or other article of furniture might be modified to include various features of the invention. For example, a cut-out might be formed in the side of an existing nightstand drawer. An opening might be formed in the rear of the drawer and the ejector 200 mechanism might be installed. Alternatively, various features of the invention might be incorporated into the article of furniture when it is constructed.

In one embodiment, various features of the invention might be configured as a kit for a drawer. For example, a kit might include a pre-assembled ejector which may be connected to a drawer once the necessary access apertures are provided therein. The kit might include mounts for routing and securing the actuator wire 218. That kit or another kit might also include a holder 100 which may be mounted to a drawer. The kit might include screws or other fasteners for securing the holder 100 to the drawer. Various instructions and templates might be provided to aid the user in installing the kit features. One or more templates might aid the user in modifying the side of a drawer 28 to include a locating cut-out 30. For example, a user might use the template as a guide to cutting the drawer with a reciprocating saw.

As indicated, one or more of the features of the invention may be applied to articles of furniture other than a nightstand. Such articles of furniture might comprise, but are not limited to, a table, a dresser, an armoire or the like.

The invention has numerous benefits and advantages. First, the invention provides for safe storage of a firearm. A firearm may be stored in an article of furniture where it is generally not accessible. In one embodiment, access to the firearm is only permitted by releasing or opening a drawer. Movement of the drawer may, however, be controlled. For example, a user may only open the drawer by actuating an actuator. In order to limit the users who may actuate the actuator, the actuator may include a user control such as a keypad requiring an access code, or other features.

Most importantly, however, the invention provides quick access to a firearm. As indicated in the Background above, many firearm safes and storage containers are known. A safe may provide for efficient safe-keeping of a firearm. However, the safe does not permit quick access to a firearm. In the event of an emergency, this makes a firearm generally useless. For example, a user may be sleeping when a burglar breaks into their home. By the time the user wakes up, travels to the safe, unlocks the safe and then rummages through the safe for a firearm, the burglar is likely to already have reached the homeowner or left the home, thus rendering the user's firearm useless in defending the home owner and their home.

As one aspect of the invention, a firearm can be kept in a normal article of furniture, rather than in safe in a wall, floor or other inaccessible location. This permits, for example, a user to store their firearm in a night stand or dresser immediately adjacent their bed. Alternatively, the user might store their firearm in other locations, such in a drawer of a side table next to a chair or couch in a living room.

In accordance with the invention, the user may move a firearm to an access position very quickly, such as by releasing the drawer ejector. This moves the drawer outwardly to a position where the firearm is immediately accessible. This represents a significant advantage over safes and the like where to gain access to the firearm the user must rotate a door of the safe to a position where the interior of the safe is accessible.

In a preferred embodiment, when the drawer is opened, the firearm is moved to an optimal grasping position for use. As indicated, this may be accomplished by mounting the firearm F on a mount 102 of a holder 100, where in the mount 102 moves the firearm F to a vertical position. Again, this represents a significant advantage over firearm safes. Generally a firearm safe simply has an open interior. The user may set various firearms in the safe. However, when the user wishes to gain access to a firearm, it may be located in the safe in various locations and various positions, including under other firearms. This makes access to a particular firearm very difficult.

In addition, in a preferred embodiment, a locator feature aids the user in locating the firearm. As indicated, an arm locating cut-out aids the user in locating the firearm F. For example, if a user is lying in their bed and needs to gain access to the firearm F, they can merely reach over and locate the firearm by locating their arm in the cut-out. This avoids, for example, the user having to sit up to look into the drawer to locate the firearm or even requiring that the user turn on a light or the like. Instead, the firearm is self-locating, with the user being able to locate the firearm by feel rather than by sight. This is particularly advantageous when the user may need access to the firearm in the night while they are sleeping.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An article of furniture with a firearm access feature comprising:

a furniture housing having at least one drawer, said drawer having an open top, a bottom, a front, a rear, an opposing pair of sides and an interior area bounded by said front, rear and opposing pair of sides, said open top and interior area generally inaccessible when said drawer is in a first position in which it is positioned in said housing and said open top and interior area generally accessible when said drawer is in a second position in which it is extended outwardly of said housing, and each of said pair of sides having a top edge;

a firearm holder located in said interior area of said drawer between said opposing sides, said firearm holder comprising a mount and a base, said base connected to said bottom of said drawer and said mount movable relative to said base from a first position to a second position, said holder when said mount is in said first position configured to support a firearm in a generally vertical position above said bottom of said drawer and in a position which said firearm may be grasped by a user reaching into said drawer from one of said sides, said firearm holder moving with said drawer between said first and second positions of said drawer, whereby said firearm holder is generally inaccessible when said drawer is in said first position and accessible when said drawer is in said second position; and at least one firearm locating feature comprising a cut-out in at least one of said sides of said drawer, said cut-out comprising a recessed portion of said top edge of said side which extends downwardly from the remainder of said top edge of said side towards said bottom of said drawer, said cut-out and said firearm holder aligned with one another between said front and rear end of said drawer, whereby said firearm locating feature locates a user's hand for grasping a firearm in said firearm holder when a user places their arm into said firearm locating feature when said drawer is in said second.

2. The article of furniture in accordance with claim 1 wherein said article of furniture is selected from the group consisting of: a night stand, a dresser and a table.

3. The article of furniture in accordance with claim 1 wherein said cut-out is generally "U" shaped.

4. The article of furniture in accordance with claim 1 wherein said mount is pivotally connected to said base.

5. The article of furniture in accordance with claim 1 further comprising means for moving said drawer from said first to said second position.

6. The article of furniture in accordance with claim 5 wherein said means comprises an ejector.

7. The article of furniture in accordance with claim 6 wherein said ejector comprises at least one spring configured to bias said drawer towards its second position and at least one latch configured to selectively maintain said drawer in said first position against said force generated by said spring.

8. The article of furniture in accordance with claim 7 wherein said latch comprises a catch movable between a first position and a second position.

9. The article of furniture in accordance with claim 8 wherein said catch further comprises a user actuator, said actuator configured to selectively move said catch from its first to its second position.

10. The article of furniture in accordance with claim 9 wherein said actuator comprises a flexible lead extending from said catch to a location remote from said catch.

11. An article of furniture with a firearm access feature comprising:

a furniture housing having at least one drawer, said drawer having an open top, a bottom, a front, a rear, an opposing pair of sides and an interior area bounded by said front, rear and opposing pair of sides, said open top and interior area generally inaccessible when said drawer is in a first position in which it is positioned in said housing and said open top and interior area generally accessible when said drawer is in a second position in which it is extended outwardly of said housing, and each of said pair of sides having a top edge;

a firearm holder located in said interior area of said drawer between said opposing sides, said firearm holder comprising a mount and a base, wherein said mount is generally "L" shaped having a bottom having a first end and a second open end and a firearm supporting surface which extends outwardly from said first end of said bottom generally perpendicular to said bottom, said base connected to said bottom of said drawer and said mount movable relative to said base from a first position to a second position, said firearm supporting surface when said mount is in said first position being generally horizontal and configured to support a firearm in a generally horizontal position and when said mount is in said second position, said firearm supporting surface being generally vertical and configured to support a firearm in a generally vertical position above said bottom of said drawer and in a position which said firearm may be grasped by a user reaching into said drawer from one of said sides, said firearm holder moving with said drawer between said first and second positions of said drawer, whereby said firearm holder is generally inaccessible when said drawer is in said first position and accessible when said drawer is in said second position; and at least one firearm locating feature comprising a cut-out in at least one of said sides of said drawer, said cut-out comprising a recessed portion of said top edge of said side which extends downwardly from the remainder of said top edge of said side towards said bottom of said drawer, said cut-out and said firearm holder aligned with one another between said front and rear end of said drawer, whereby said firearm locating feature locates a user's hand for grasping a firearm in said firearm holder when a user places their arm into said firearm locating feature when said drawer is in said second.

12. The article of furniture in accordance with claim 11 wherein said article of furniture is selected from the group consisting of: a night stand, a dresser and a table.

13. The article of furniture in accordance with claim 11 wherein said cut-out is generally "U" shaped.

14. The article of furniture in accordance with claim 11 wherein said mount is pivotally connected to said base.

15. The article of furniture in accordance with claim 11 further comprising means for moving said drawer from said first to said second position.

16. The article of furniture in accordance with claim 15 wherein said means comprises an ejector.

17. The article of furniture in accordance with claim 16 wherein said ejector comprises at least one spring configured to bias said drawer towards its second position and at least one latch configured to selectively maintain said drawer in said first position against said force generated by said spring.

18. The article of furniture in accordance with claim 17 wherein said latch comprises a catch movable between a first position and a second position.

19. The article of furniture in accordance with claim 18 wherein said catch further comprises a user actuator, said actuator configured to selectively move said catch from its first to its second position.

20. The article of furniture in accordance with claim 19 wherein said actuator comprises a flexible lead extending from said catch to a location remote from said catch.

* * * * *

UNITED STATES PATENT AND TRADEMARK OFFICE

CERTIFICATE OF CORRECTION

PATENT NO. : 8,430,461 B1
APPLICATION NO. : 13/299187
DATED : April 30, 2013
INVENTOR(S) : Joseph W. Cole It is certified that error appears in the above-identified patent and that said Letters Patent is hereby corrected as shown below:

In the Claims

In Claim 1 at Column 11, Line 22: add the word --position-- at the end of the sentence after "said second".

In Claim 11 at Column 12, Line 34: add the word --position-- at the end of the sentence after "said second".

Signed and Sealed this
Twentieth Day of May, 2014

Michelle K. Lee

Michelle K. Lee
*Deputy Director of the United States Patent and Trademark Office*